US009659704B2

(12) United States Patent
Yang et al.

(10) Patent No.: US 9,659,704 B2
(45) Date of Patent: May 23, 2017

(54) CHIP ELECTRONIC COMPONENT

(71) Applicant: SAMSUNG ELECTRO-MECHANICS CO., LTD., Suwon-Si, Gyeonggi-Do (KR)

(72) Inventors: Yun Young Yang, Suwon-Si (KR); Youn Kyu Choi, Suwon-Si (KR); Hye Ah Kim, Suwon-Si (KR); Do Won Kang, Suwon-Si (KR); Mi Jung Kang, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/885,812

(22) Filed: Oct. 16, 2015

(65) Prior Publication Data

US 2016/0126004 A1 May 5, 2016

(30) Foreign Application Priority Data

Nov. 4, 2014 (KR) ..... 10-2014-0152057

(51) Int. Cl.

| | |
|---|---|
| ***H01F 27/24*** | (2006.01) |
| ***H01F 27/28*** | (2006.01) |
| ***H01F 27/29*** | (2006.01) |
| ***H01F 17/00*** | (2006.01) |
| *H01F 17/04* | (2006.01) |

(52) U.S. Cl.

CPC ..... *H01F 27/292* (2013.01); *H01F 17/0013* (2013.01); *H01F 2017/048* (2013.01)

(58) Field of Classification Search

None

See application file for complete search history.

(56) References Cited

U.S. PATENT DOCUMENTS

| | | | | |
|---|---|---|---|---|
| 6,710,694 | B2 * | 3/2004 | Matsuta | H01F 17/0013 336/200 |
| 2013/0113593 | A1 | 5/2013 | Jeong et al. | |
| 2013/0222101 | A1 * | 8/2013 | Ito | H01F 17/04 336/83 |
| 2013/0249664 | A1 * | 9/2013 | Tonoyama | H01F 41/04 336/200 |

FOREIGN PATENT DOCUMENTS

| | | |
|---|---|---|
| JP | 2006-24677 A | 1/2006 |
| JP | 2008-166455 A | 7/2008 |

(Continued)

OTHER PUBLICATIONS

Korean Office Action dated Sep. 2, 2015, issued in corresponding Korean Patent Application No. 10-2014-0152057. (w/ English translation).

*Primary Examiner* — Elvin G Enad
*Assistant Examiner* — Ronald Hinson
(74) *Attorney, Agent, or Firm* — McDermott Will & Emery LLP

(57) ABSTRACT

A chip electronic component includes a magnetic body containing magnetic metal powder, internal coil parts embedded in the magnetic body, and an anti-plating layer disposed on at least one of upper and lower surfaces of the magnetic body. The anti-plating layer contains magnetic metal powder having particle sizes within the range of 0.1 μm to 10 μm.

15 Claims, 8 Drawing Sheets

(56) References Cited

FOREIGN PATENT DOCUMENTS

| | | | |
|---|---|---|---|
| JP | 2013-201375 | A | 10/2013 |
| JP | 2013-254917 | A | 12/2013 |
| KR | 10-1194785 | B1 | 10/2012 |
| KR | 10-2013-0049875 | A | 5/2013 |
| KR | 10-2014-0069595 | A | 6/2014 |

* cited by examiner

A

A

CHIP ELECTRONIC COMPONENT

CROSS-REFERENCE TO RELATED APPLICATION

This application claims the priority and benefit of Korean Patent Application No. 10-2014-0152057 filed on Nov. 4, 2014, with the Korean Intellectual Property Office, the disclosure of which is incorporated herein by reference.

BACKGROUND

The present disclosure relates to a chip electronic component.

An inductor, a chip electronic component, is a representative passive element configuring an electronic circuit together with a resistor and a capacitor to remove noise.

A thin-film inductor is manufactured by forming internal coil parts using a plating process, hardening a magnetic powder-resin composite in which magnetic metal powder and a resin are mixed with each other to manufacture a magnetic body, and forming external electrodes on outer surfaces of the magnetic body.

SUMMARY

An aspect of the present disclosure may provide a chip electronic component capable of preventing a plating spreading phenomenon occurring on surfaces thereof at the time of forming external electrodes.

According to an aspect of the present disclosure, a chip electronic component may include: a magnetic body containing magnetic metal powder; internal coil parts embedded in the magnetic body; and an anti-plating layer disposed on at least one of the upper and lower surfaces of the magnetic body, wherein the anti-plating layer contains magnetic metal powder having particle sizes within the range of 0.1 μm to 10 μm.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
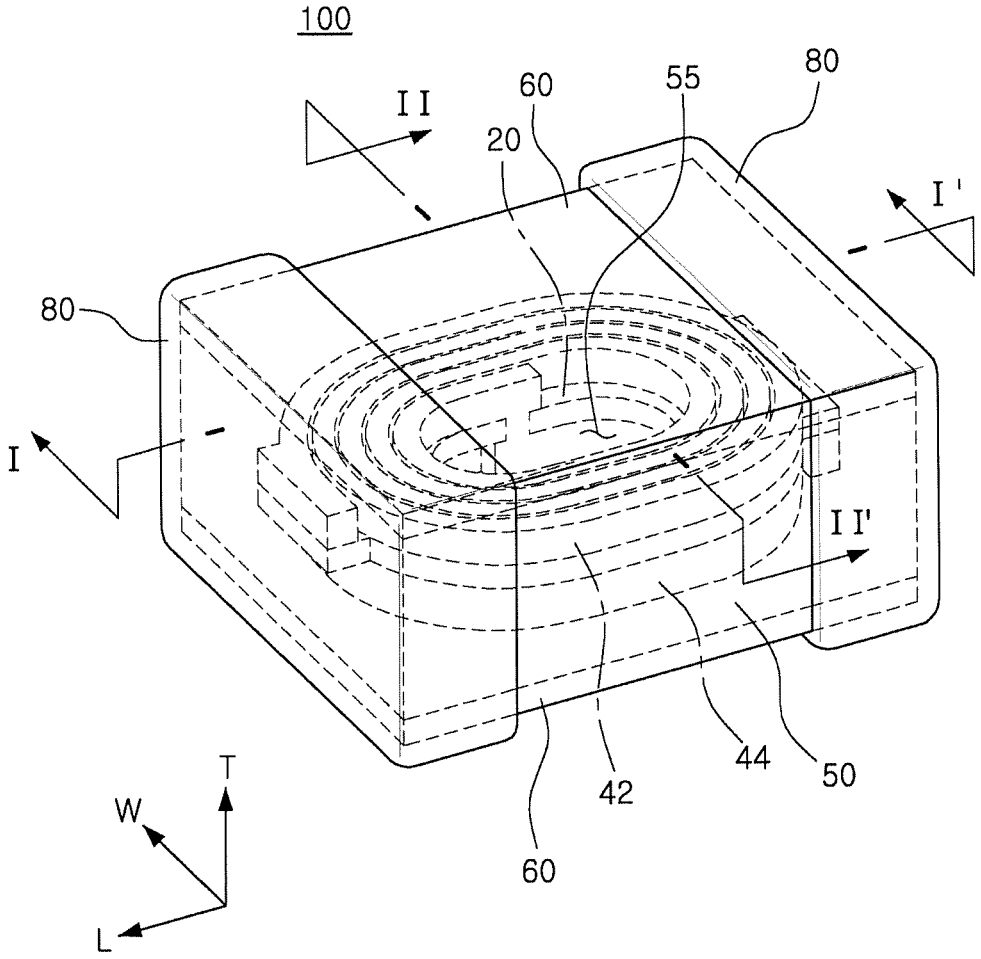
FIG. 1 is a perspective view schematically illustrating a chip electronic component according to an exemplary embodiment in the present disclosure so that the internal coil parts of the chip electronic component are visible.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Chip Electronic Component

Hereinafter, a chip electronic component according to an exemplary embodiment in the present disclosure, particularly, a thin-film inductor, will be described, but is not limited thereto.

FIG. 1 is a perspective view schematically illustrating a chip electronic component according to an exemplary embodiment in the present disclosure so that the internal coil parts of the chip electronic component are visible.

Referring to FIG. 1, a thin-film inductor used in a power line of a power supplying circuit is disclosed as an example of the chip electronic component.

The chip electronic component 100 according to an exemplary embodiment in the present disclosure may include a magnetic body 50, internal coil parts 42 and 44 embedded in the magnetic body 50, anti-plating layers 60 disposed on upper and lower surfaces of the magnetic body 50, and external electrodes 80 disposed on outer surfaces of the magnetic body 50 to be respectively electrically connected to the internal coil parts 42 and 44.

In the chip electronic component 100 according to the exemplary embodiment in the present disclosure, a 'length' direction refers to an 'L' direction of FIG. 1, a 'width' direction refers to a 'W' direction of FIG. 1, and a 'thickness' direction refers to a 'T' direction of FIG. 1.

The magnetic body 50 may contain magnetic metal powder.

The magnetic metal powder may be provided as an alloy containing at least one selected from a group consisting of iron (Fe), silicon (Si), chromium (Cr), aluminum (Al), or nickel (Ni). For example, the magnetic metal powder may contain a Fe—Si—B—Cr-based amorphous metal particle, but is not limited thereto.

The magnetic metal powder may be dispersed in the thermosetting resin such as an epoxy resin, a polyimide resin, and the like to be contained therein.

In order to improve a packing factor of the magnetic metal powder contained in the magnetic body 50, two or more kinds of magnetic metal powders having different particle sizes may be mixed with each other at a predetermined ratio.

Magnetic metal powder having a large particle size and high magnetic permeability may be used in order to obtain high inductance in a unit volume, and magnetic metal powder having a small particle size may be mixed with the magnetic metal powder having a large particle size to improve a packing factor, whereby a high magnetic permeability may be secured, and an efficiency reduction occurring due to core loss at a high frequency and a high current may be prevented.

However, in a case in which magnetic metal powder having a large particle size and magnetic metal powder having a small particle size are mixed with each other as described above, large surface roughness of the magnetic body may occur. Especially, the magnetic metal powder having the large particle size may protrude on a surface of the magnetic body during a process of polishing the magnetic body cut to an individual chip size, and an insulating coating layer in a protruding portion thereof may be peeled off.

Accordingly, at a later time when plating layers of the external electrodes are formed, the plating layers may be formed on the magnetic metal powder having the peeled-off insulating coating layer, which is a defect of plating spreading.

Thus, in the exemplary embodiment in the present disclosure, the anti-plating layer 60 formed of fine powders of a small particle size may be formed on at least one of the upper and lower surfaces of the magnetic body 50 to resolve the above-mentioned problem.

A detailed description of the anti-plating layer 60 according to an exemplary embodiment in the present disclosure will be provided below.

An insulating substrate 20 disposed within the magnetic body 50 may have the internal coil parts 42 and 44 formed on one surface and the other surface thereof, respectively, wherein the internal coil parts 42 and 44 have coil-shaped patterns.

The insulating substrate 20 may be provided as, for example, a polypropylene glycol (PPG) substrate, a ferrite substrate, a metal-based soft magnetic substrate, or the like.

The insulating substrate 20 may have a hole penetrating through a central portion thereof, wherein the hole may be filled with magnetic metal powder to form a core part 55. The core part 55 filled with the magnetic metal powder may be formed to improve inductance.

The internal coil parts 42 and 44 may include coil patterns formed in a spiral shape, and the internal coil parts 42 and 44 formed on one surface and the other surface of the insulating substrate 20, respectively, may be electrically connected to each other through a via electrode formed in the insulating substrate 20.

The internal coil parts 42 and 44 and the via electrode may be formed of a metal having excellent electrical conductivity, such as silver (Ag), palladium (Pd), aluminum (Al), nickel (Ni), titanium (Ti), gold (Au), copper (Cu), platinum (Pt), an alloy thereof, or the like.

One end portion of the internal coil part 42 formed on one surface of the insulating substrate 20 may be exposed to one end surface of the magnetic body 50 in the length direction thereof, and one end portion of the internal coil part 44 formed on the other surface of the insulating substrate 20 may be exposed to the other end surface of the magnetic body 50 in the length direction thereof.

The external electrodes 80 may be formed on both end surfaces of the magnetic body 50 in the length direction thereof, respectively, to be connected to the internal coil parts 42 and 44 exposed to both end surfaces of the magnetic body 50 in the length direction thereof, respectively.

The external electrodes 80 may be formed of a conductive metal having excellent electrical conductivity, such as nickel (Ni), copper (Cu), tin (Sn), silver (Ag), an alloy thereof, or the like.

Figure 2:
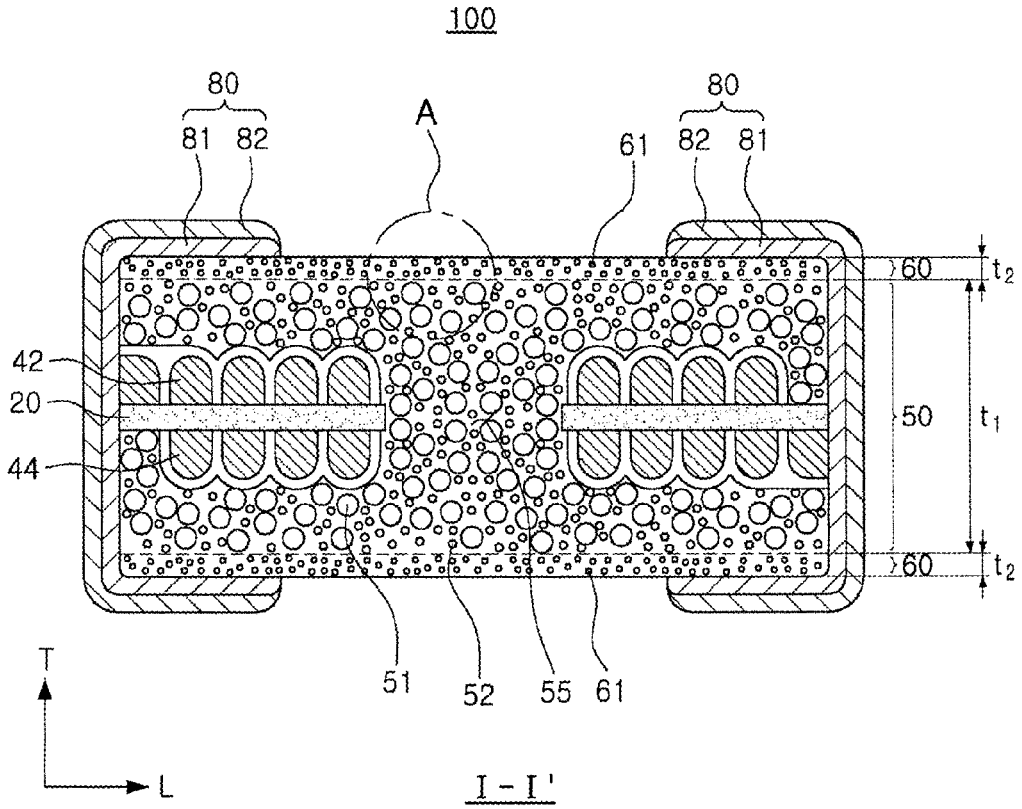
FIG. 2 is a cross-sectional view taken along line I-I' of FIG. 1.
Figure 3:
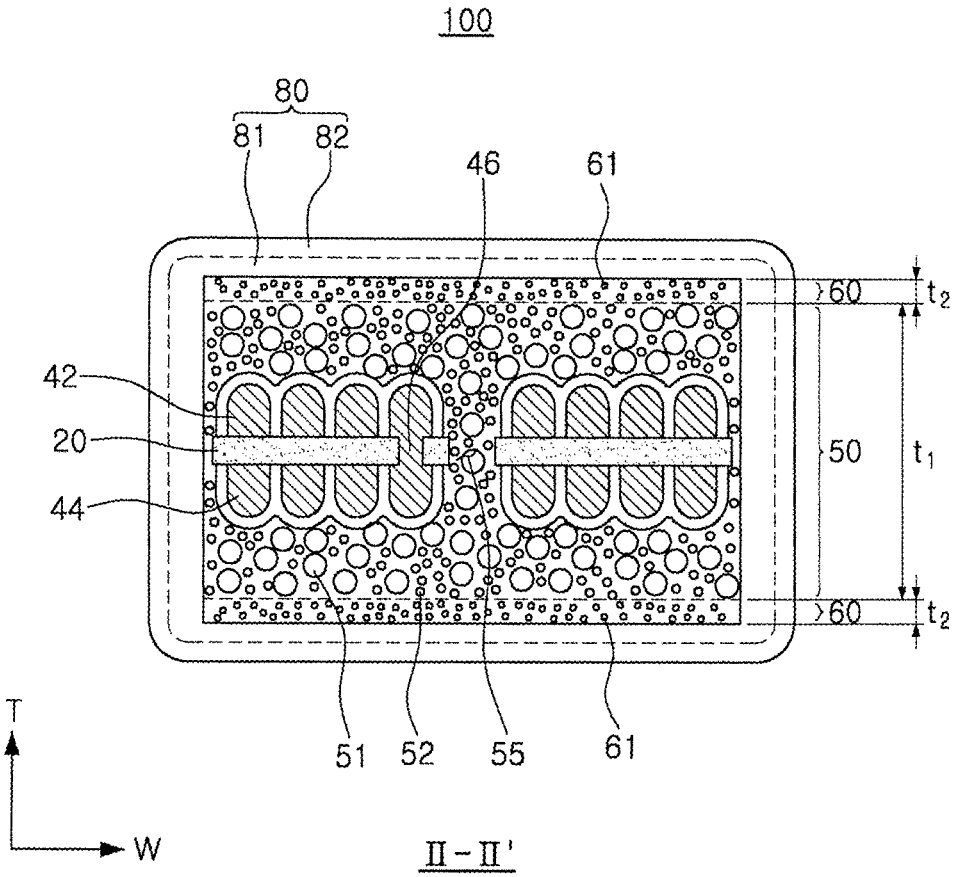
FIG. 3 is a cross-sectional view taken along line II-II' of FIG. 1.

FIG. 2 is a cross-sectional view taken along line I-I' of FIG. 1, and FIG. 3 is a cross-sectional view taken along line II-II' of FIG. 1.

Referring to FIGS. 2 and 3, the magnetic body 50 according to an exemplary embodiment may contain a mixture of first magnetic metal powder 51 and second magnetic metal powder 52 having a median diameter smaller than that of the first magnetic metal powder 51. The median diameter can be a computed D50 value, but the method for determining a median diameter is not restricted thereto.

The first magnetic metal powder 51 having relatively large median diameter may implement a high magnetic permeability, and the first magnetic metal powder 51 having relatively large median diameter and the second magnetic metal powder 52 having relatively small median diameter may be mixed with each other, such that a packing factor of the magnetic metal powder is increased, whereby a magnetic permeability may be further improved and a quality (Q) factor may be improved.

The median diameter of the first magnetic metal powder 51 may range from 18 to 22 μm, and median diameter of the second magnetic metal powder 52 may range from 2 μm to 4 μm.

The median diameter may be measured using a particle diameter and particle size distribution measuring apparatus which utilizes a laser diffraction scattering method.

A particle sizes of the first magnetic metal powder 51 may be 10 μm to 50 μm, and a particle sizes of the second magnetic metal powder 52 may be 0.5 μm to 6 μm.

The magnetic body 50 may contain a mixture of the first magnetic metal powder 51 having a relatively large average particle size and the second magnetic metal powder 52 having an average particle size smaller than that of the first magnetic metal powder 51.

The first and second magnetic metal powder 51 and 52 may be mixed with each other at a weight ratio of 8:2 to 5:5.

Since the first and second magnetic metal powder 51 and 52 are mixed with each other at the weight ratio in the above-mentioned range, a packing factor of the magnetic metal powder may be improved, such that magnetic permeability may be increased and inductance may be improved.

The magnetic body 50 may have magnetic permeability of 31 H/m to 50 H/m.

The external electrodes 80 respectively connected to the end portions of the internal coil parts 42 and 44 may be formed on the outer surfaces of the magnetic body 50.

Each external electrode 80 may include an electrode layer 81 formed using a conductive paste and a plating layer 82 formed on the electrode layer through a plating process.

The electrode layer 81 may be provided as a conductive resin layer containing at least one conductive metal selected from a group consisting of copper (Cu), nickel (Ni), or silver (Ag), as well as a thermosetting resin.

The plating layer 82 may contain at least one selected from a group consisting of nickel (Ni), copper (Cu), or tin (Sn). For example, a nickel (Ni) layer and a tin (Sn) layer may be sequentially formed in the plating layer 82.

During a plating process in which the plating layer 82 is formed, the plating layer may be formed on magnetic metal powder of coarse particles exposed to the surface of the magnetic body 50, which is a plating spreading defect.

However, according to an exemplary embodiment in the present disclosure, high insulation resistance layers 60 formed of magnetic metal powder of fine particles to have high insulation resistance may be formed on the upper and lower surfaces of the magnetic body 50 to serve as anti-plating layers.

The high insulation resistance layer and the anti-plating layer may be the same component. Therefore, hereinafter, only the anti-plating layer will be described.

In a case in which magnetic metal powder of coarse particles is used in order to implement high magnetic permeability, the magnetic metal powder of coarse particles may be exposed to the surface of the magnetic body 50, and thus, plating layers may formed on exposed portions of the magnetic metal powder of coarse particles when the plating layer 82 of the external electrode is formed.

According to an exemplary embodiment in the present disclosure, the anti-plating layers 60 formed of the magnetic metal powder of fine particles may be formed on the upper and lower surfaces of the magnetic body 50 to improve surface roughness of the magnetic body 50 and prevent a plating spreading phenomenon occurring due to coarse powder.

Since the anti-plating layer 60 may contain magnetic metal powder 61, a reduction in inductance occurring due to a decrease in a thickness of the magnetic body may be prevented by forming the anti-plating layer 60.

That is, the anti-plating layer 60 may contain the magnetic metal powder 61 of fine particles to prevent the plating spreading phenomenon and contribute to improving inductance.

When a thickness of the magnetic body 50 is $t_1$ and a thickness of the anti-plating layer 60 is $t_2$, $t_2/t_1$ may be 0.25 or less.

In a case in which $t_2/t_1$ exceeds 0.25, the thickness of the magnetic body may be significantly reduced, such that inductance may be significantly reduced.

The anti-plating layer 60 may have a thickness of 5 μm to 20 μm.

In a case in which the thickness of the anti-plating layer 60 is less than 5 μm, improvement of the surface roughness of the magnetic body may be insufficient, and thus a plating spreading phenomenon may occur. In a case in which the thickness of the anti-plating layer 60 exceeds 20 μm, the thickness of the magnetic body may be significantly reduced, and thus inductance may be significantly reduced.

The anti-plating layer 60 may have an insulation resistance of 700 MΩ or higher.

The anti-plating layer 60 may be formed of the magnetic metal powder 61 of fine particles to have a relatively high insulation resistance of 700 MΩ or higher.

In a case in which the insulation resistance of the anti-plating layer 60 is less than 700 MΩ, a plating spreading suppressing effect may be insufficient, and thus a defect may occur in which the plating layers are formed on the exposed portions of the magnetic metal powder of coarse particles the plating layer 82 of the external electrode is formed.

Figure 4:
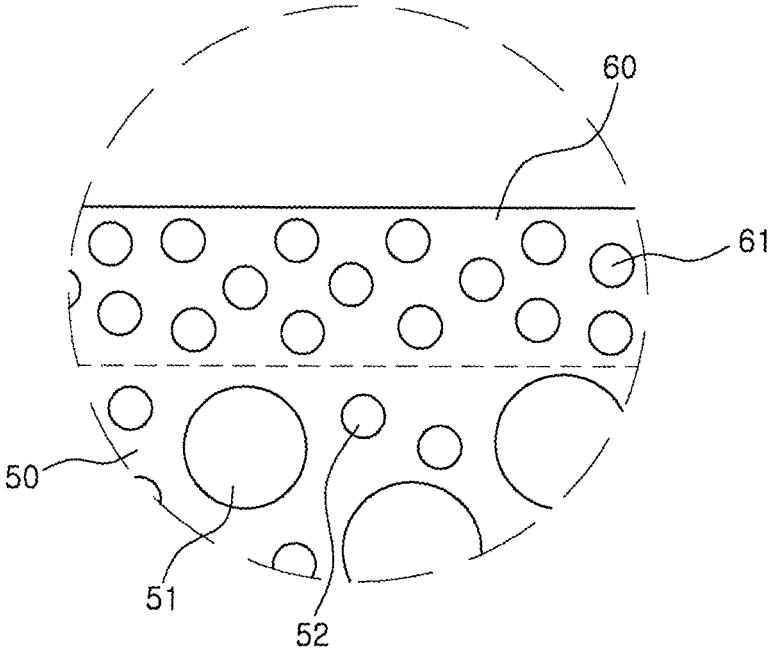
FIG. 4 is an enlarged view schematically illustrating an example of part 'A' of FIG. 2.

FIG. 4 is an enlarged view schematically illustrating an example of part 'A' of FIG. 2.

Referring to FIG. 4, the anti-plating layer 60 may contain the magnetic metal powder 61 of fine particles having sizes within the range of 0.1 μm to 10 μm.

In a case in which a particle size of the magnetic metal powder 61 contained in the anti-plating layer 60 is less than 0.1 μm, a packing factor and magnetic permeability may be reduced, and thus inductance may be reduced. In a case in which a particle size of the magnetic metal powder 61 contained in the anti-plating layer 60 exceeds 10 μm, improvement of the surface roughness of the magnetic body may be insufficient, and thus the plating spreading phenomenon may occur.

The anti-plating layer 60 may further contain a thermosetting resin, and the magnetic metal powder 61 may be dispersed in a thermosetting resin such as an epoxy resin, a polyimide resin, or the like, to be contained therein.

A content of the thermosetting resin contained in the anti-plating layer 60 may be 15 wt % to 30 wt %.

Figure 5:
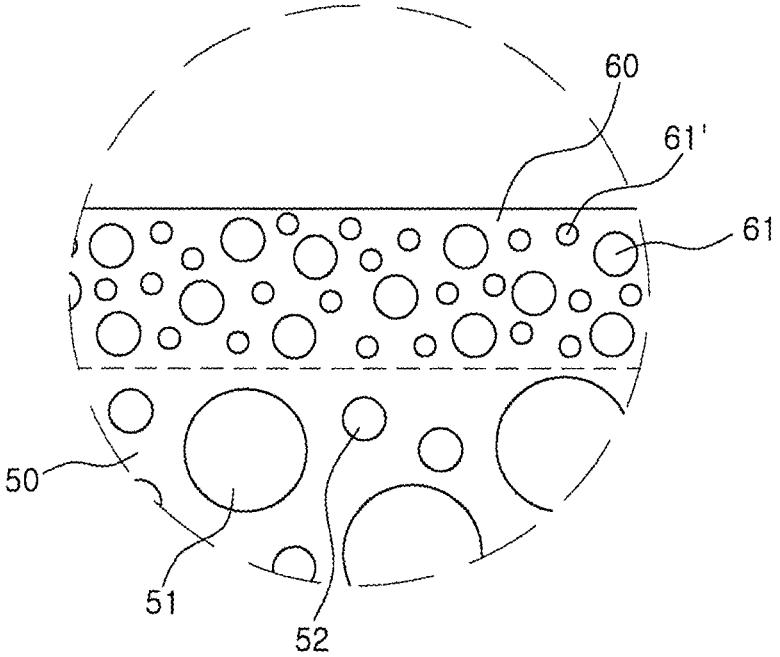
FIG. 5 is an enlarged view schematically illustrating another example of part 'A' of FIG. 2.

FIG. 5 is an enlarged view schematically illustrating another example of part 'A' of FIG. 2.

Referring to FIG. 5, the anti-plating layer 60 may contain a mixture of magnetic metal powder 61 and 61' of fine particles having different average sizes.

For example, the anti-plating layer 60 may contain the magnetic metal powder 61 having a median diameter of 1.5 μm to 3.5 μm and the magnetic metal powder 61' having a median diameter of 0.3 μm to 1.5 μm, which is smaller than that of the magnetic metal powder 61.

As described above, the anti-plating layer 60 may contain the mixture of the magnetic metal powders 61 and 61' of fine particles having different median diameter, such that a packing factor of the magnetic metal powder may be improved. The packing factor of the magnetic powder contained in the anti-plating layer 60 may be improved to suppress a decrease in inductance occurring due to the formation of the anti-plating layer 60 and deterioration of direct current (DC) bias characteristics, improve surface roughness, and prevent a plating spreading phenomenon.

The anti-plating layer 60 according to an exemplary embodiment in the present disclosure may have a magnetic permeability of 15 H/m to 30 H/m.

In addition, the anti-plating layer 60 according to an exemplary embodiment in the present disclosure may be implemented to have a surface roughness less than 0.5 μm. Accordingly, the plating spreading phenomenon occurring when the plating layer 82 of the external electrode is formed may be prevented.

Method of Manufacturing Chip Electronic Component

Figure 6:
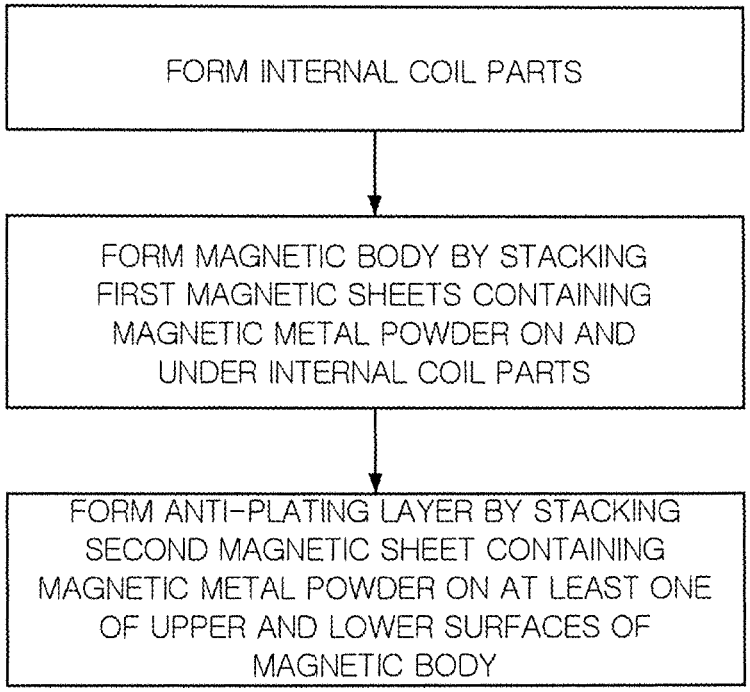
FIG. 6 is a flow chart illustrating a method of manufacturing a chip electronic component according to an exemplary embodiment in the present disclosure.

FIG. 6 is a flow chart illustrating a method of manufacturing a chip electronic component according to an exemplary embodiment in the present disclosure. FIGS. 7A through 7E are views sequentially illustrating a method of manufacturing a chip electronic component according to an exemplary embodiment in the present disclosure.

Figure 7A:
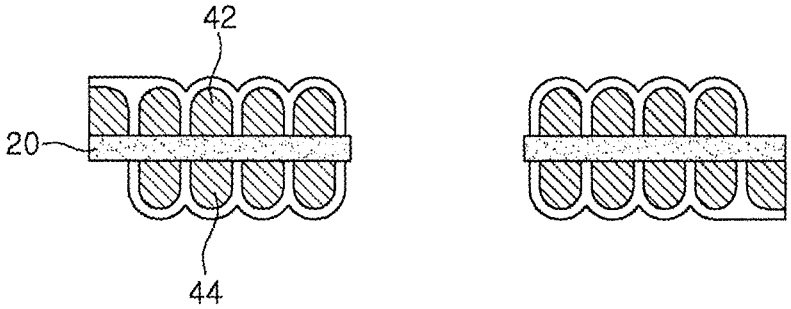
FIGS. 7A through 7E are views sequentially illustrating a method of manufacturing a chip electronic component according to an exemplary embodiment in the present disclosure.

Referring to FIGS. 6 and 7A, internal coil parts 42 and 44 may be formed on one surface and the other surface of the insulating substrate 20, respectively.

The internal coil parts 42 and 44 may be formed using, for example, an electroplating method, but are not limited thereto. The internal coil parts 42 and 44 may be formed of a metal having excellent electrical conductivity, such as silver (Ag), palladium (Pd), aluminum (Al), nickel (Ni), titanium (Ti), gold (Au), copper (Cu), platinum (Pt), an alloy thereof, or the like.

Figure 7B:
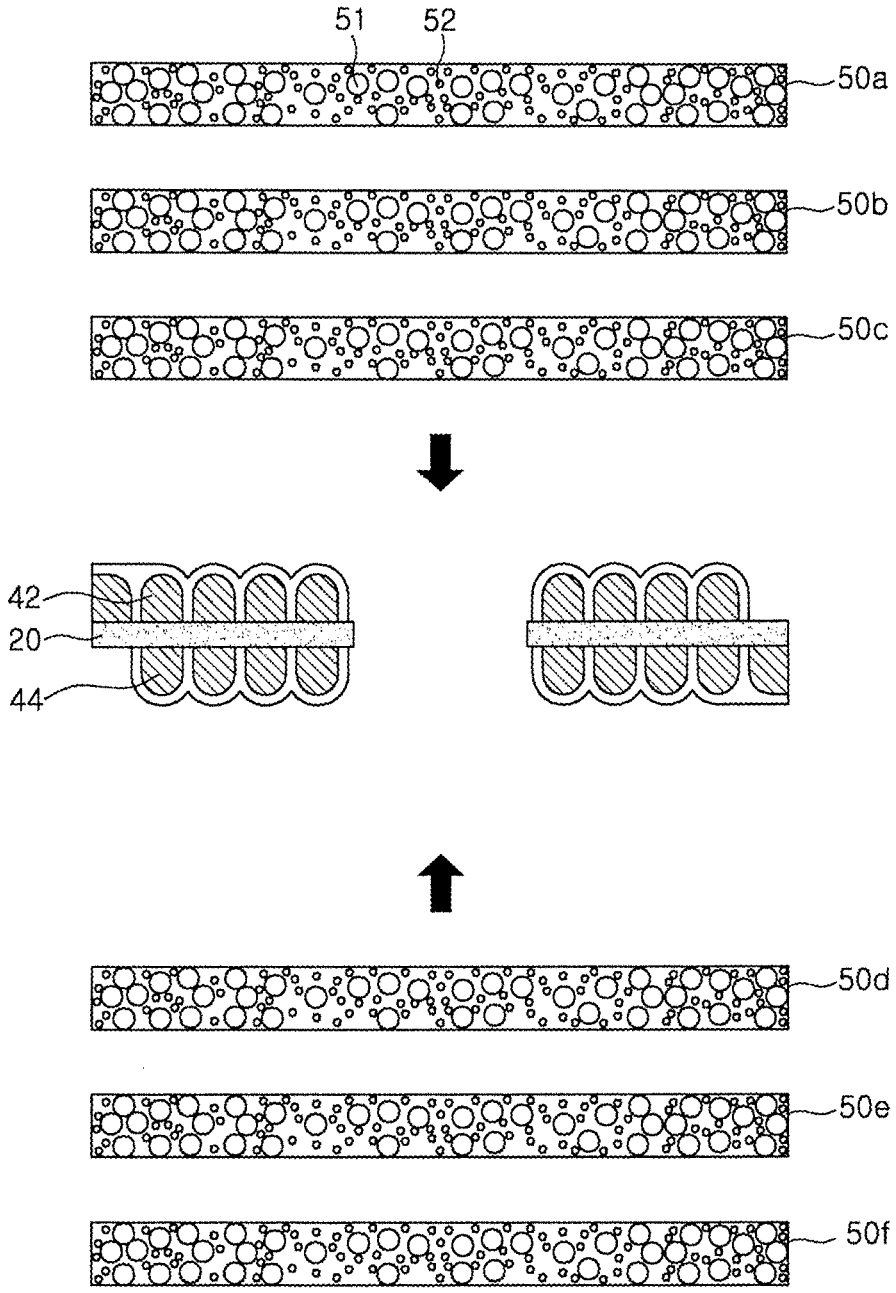

Referring to FIGS. 6 and 7B, a plurality of first magnetic sheets 50*a* to 50*c* and 50*d* to 50*f* may be stacked on and under the internal coil parts 42 and 44, respectively, to form the magnetic body 50.

The first magnetic sheets 50*a* to 50*f* may be manufactured in sheet shapes by producing slurry with a mixture of magnetic powder such as magnetic metal powder, and an organic material such as a binder, a solvent, or the like, applying the slurry at a thickness of several tens of micrometers onto carrier films using a doctor blade method, and then drying the slurry.

The first magnetic sheets 50*a* to 50*f* may be formed of the mixture of the first magnetic metal powder 51 and the second magnetic metal powder 52 having a median diameter smaller than that of the first magnetic metal powder 51.

The median diameter of the first magnetic metal powder 51 may be 18 to 22 μm, and the median diameter of the second magnetic metal powder 52 may be 2 to 4 μm.

The particle sizes of the first magnetic metal powder particles 51 may be 10 μm to 50 μm, and the particle sizes of the second magnetic metal powder particles 52 may be 0.5 μm to 6 μm.

The plurality of first magnetic sheets 50*a* to 50*f* may be stacked, compressed through a laminate method or an isostatic press method, and then hardened to form the magnetic body 50.

The first magnetic metal powder 51 of coarse particles may protrude on a surface of the magnetic body during a process in which the magnetic body cut to an individual chip size is polished, and an insulating coating layer at protruding portions thereof may be peeled off.

Accordingly, at the time in which the plating layers of the external electrodes is formed, the plating spreading defect may occur in which the plating layers are formed on the magnetic metal powder in which the insulating coating layer has been peeled off.

Figure 7C:
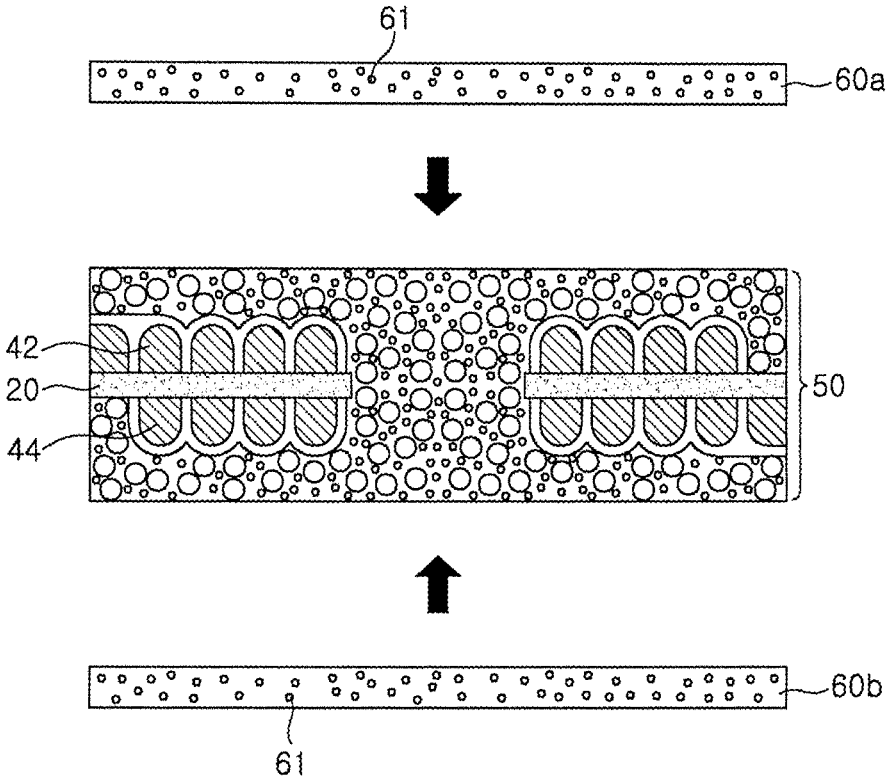

Referring to FIGS. 6 and 7C, second magnetic sheets 60*a* and 60*b* may be stacked on at least one of the upper and lower surfaces of the magnetic body 50 to form the anti-plating layer 60.

The second magnetic sheets 60*a* and 60*b* may be manufactured in sheet shapes by producing slurry with a mixture of fine magnetic metal powder and organic materials such as a binder, a solvent, or the like, applying the slurry at a thickness of several tens of micrometers onto carrier films through a doctor blade method, and then drying the slurry.

The second magnetic sheets 60*a* and 60*b* may contain the magnetic metal powder 61 having particle sizes within the range of 0.1 μm to 10 μm.

The second magnetic sheets 60*a* and 60*b* may be formed of the magnetic metal powder 61 of fine particles to have an insulation resistance higher than that of the first magnetic sheets 50*a* to 50*f*.

The second magnetic sheets 60*a* and 60*b* may be stacked and compressed through a laminate method or an isostatic press method to form the anti-plating layers 60.

As described above, the anti-plating layers 60 formed of the magnetic metal powder of fine particles may be formed on the upper and lower surfaces of the magnetic body 50 to improve surface roughness of the magnetic body 50 and prevent a plating spreading phenomenon occurring due to coarse powders.

Although only an example in which the second magnetic sheets 60*a* and 60*b* contain the magnetic metal powder 61 of fine particles has been illustrated in FIG. 7C, the second magnetic sheets 60*a* and 60*b* are not limited to containing the magnetic metal powder 61, but may also contain mixtures of magnetic metal powder 61 and 61' of fine particles having different average sizes.

Figure 7D:
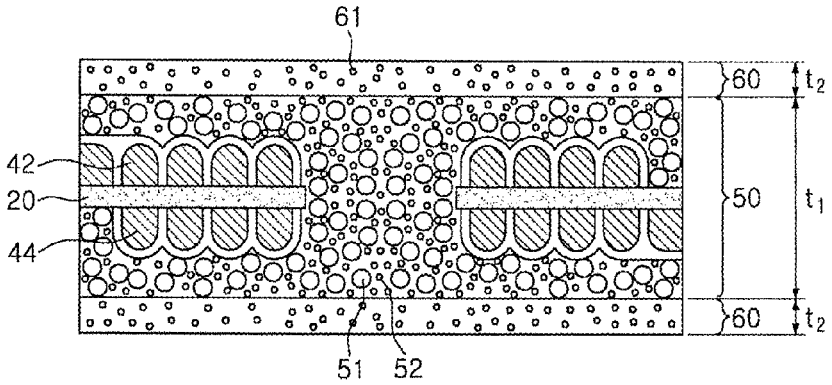

Referring to FIG. 7D, when the thickness of the magnetic body 50 is $t_1$ and the thickness of the anti-plating layers 60 is $t_2$, the magnetic body 50 and the anti-plating layer 60 may be formed so that $t_2/t_1 \leq 0.25$ is satisfied.

In a case in which $t_2/t_1$ exceeds 0.25, the thickness of the magnetic body may be significantly reduced, such that inductance may be significantly reduced.

Figure 7E:
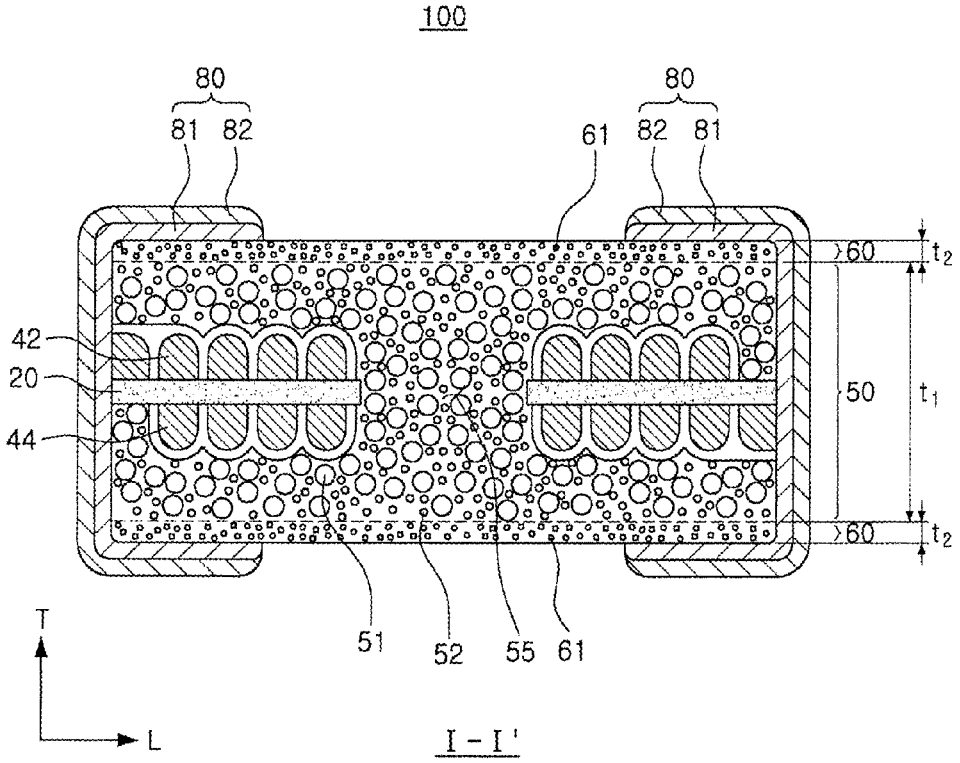

Referring to FIG. 7E, the external electrodes 80 may be formed on both end surfaces of the magnetic body 50 in the length direction thereof, respectively, to be connected to the internal coil parts 42 and 44 exposed to both end surfaces of the magnetic body 50 in the length direction thereof, respectively.

First, the electrode layers 81 may be formed on both end surfaces of the magnetic body 50 in the length direction, and the plating layers 82 may be formed on the electrode layers 81.

The electrode layer 81 may be formed as a conductive resin layer using pastes containing at least one conductive metal selected from a group consisting of copper (Cu), nickel (Ni), or silver (Ag), as well as a thermosetting resin. For example, the electrode layer 81 may be formed using a dipping method, or the like.

For example, a nickel (Ni) layer and a tin (Sn) layer may be sequentially formed in the plating layer 82.

According to an exemplary embodiment in the present disclosure, the anti-plating layer 60 may be formed on at least one of the upper and lower surfaces of the magnetic body 50, whereby the plating spreading phenomenon in which the plating layers are formed on the magnetic metal powder exposed to the surface of the magnetic body 50 at the time in which the plating layer 82 of the external electrode is formed may be prevented.

A description for the same features as those of the chip electronic component according to an exemplary embodiment in the present disclosure described above will be omitted.

As set forth above, according to exemplary embodiments in the present disclosure, the plating spreading phenomenon occurring on the surface of the chip electronic component when the external electrodes are formed may be prevented.

While exemplary embodiments have been shown and described above, it will be apparent to those skilled in the art that modifications and variations could be made without departing from the scope of the present invention as defined by the appended claims.

What is claimed is:

1. A chip electronic component comprising:

a magnetic body containing a magnetic metal powder;

internal coil parts embedded in the magnetic body; and an anti-plating layer containing a magnetic metal powder having particle sizes within the range of 0.1 μm to 10 μm and disposed on at least one of upper and lower surfaces of the magnetic body, wherein the median diameter of the metal powder contained in the anti-plating layer is less than the median diameter of the metal powder contained in the magnetic body.

2. The chip electronic component of claim 1, wherein when a thickness of the magnetic body is $t_1$ and a thickness of the anti-plating layer is $t_2$, $t_2/t_1$ is 0.25 or less.

3. The chip electronic component of claim 1, wherein the anti-plating layer has a thickness of 5 μm to 20 μm.

4. The chip electronic component of claim 1, wherein the anti-plating layer has an insulation resistance of 700 MΩ or more.

5. The chip electronic component of claim 1, wherein the anti-plating layer further contains a thermosetting resin, and a content of the thermosetting resin contained in the anti-plating layer is 15 wt % to 30 wt %.

6. The chip electronic component of claim 1, wherein the anti-plating layer has a magnetic permeability of 15 H/m to 30 H/m.

7. The chip electronic component of claim 1, wherein the anti-plating layer has a surface roughness less than 0.5 μm.

8. The chip electronic component of claim 1, wherein the magnetic body contains a first magnetic metal powder and a second magnetic metal powder having an average particle size smaller than an average particle size of the first magnetic metal powder, and the first magnetic metal powder has particle sizes within the range of 10 μm to 50 μm and the second magnetic metal powder has particle sizes within the range of 0.5 μm to 6 μm.

9. The chip electronic component of claim 8, wherein the first and second magnetic metal powders are mixed with each other at a weight ratio of 8:2 to 5:5.

10. The chip electronic component of claim 1, wherein the magnetic body has a magnetic permeability of 31 H/m to 50 H/m.

11. The chip electronic component of claim 1, further comprising external electrodes disposed on outer surfaces of the magnetic body to be connected to end portions of the internal coil parts, wherein the external electrodes include electrode layers and plating layers formed on the electrode layers, respectively.

12. The chip electronic component of claim 11, wherein the plating layer contains one or more selected from a group consisting of nickel (Ni), copper (Cu), and tin (Sn).

13. A chip electronic component comprising:

a magnetic body containing a magnetic metal powder;

internal coil parts embedded in the magnetic body; and a high insulation resistance layer containing a magnetic metal powder and disposed on at least one of upper and lower surfaces of the magnetic body, wherein the median diameter of the metal powder contained in the high insulation resistance layer is less than the median diameter of the metal powder contained in the magnetic body, and the high insulation resistance layer has an insulation resistance of 700 MΩ or more.

14. The chip electronic component of claim 13, wherein the high insulation resistance layer contains a magnetic metal powder having particle sizes within the range of 0.1 μm to 10 μm.

15. The chip electronic component of claim 13, wherein when a thickness of the magnetic body is $t_1$ and a thickness of the high insulation resistance layer is $t_2$, $t_2/t_1$ is 0.25 or less.

* * * * *